United States Patent [19]

Barnes et al.

[11] Patent Number: 4,763,673

[45] Date of Patent: Aug. 16, 1988

[54] METHOD AND APPARATUS FOR EJECTING TOBACCO FROM FILTER CIGARETTES

[75] Inventors: Vernon B. Barnes, Winston-Salem; Donald R. Wilkinson, Clemmons; John W. Shore, Hamptonville; Ronnie G. Huff, Kernersville, all of N.C.

[73] Assignee: R. J. Reynolds Tobacco Company, Winston-Salem, N.C.

[21] Appl. No.: 698,024

[22] Filed: Feb. 4, 1985

[51] Int. Cl.[4] ..... A24C 5/36

[52] U.S. Cl. ..... 131/96; 131/94

[58] Field of Search ..... 131/96, 94

[56] References Cited

U.S. PATENT DOCUMENTS 3,026,880 3/1962 Perrin ..... 131/96
3,103,222 9/1963 Di Ianni ..... 131/96
3,757,799 9/1973 Di Ianni et al. ..... 131/96
4,117,852 10/1978 Newman et al. ..... 131/96

*Primary Examiner*—Vincent Millin
*Attorney, Agent, or Firm*—Herbert J. Bluhm

[57] ABSTRACT

Tobacco is reclaimed from filter cigarettes by applying sufficient pressurized air to the filter end of each cigarette to eject the tobacco from the cigarettes. The method for reclaiming the tobacco involves (a) transporting a succession of filter cigarettes along a predetermined path, in a discontinuous, indexing manner, (b) temporarily engaging the filter end of each cigarette with reciprocating mouthpiece means during the pause between indexed movements and (c) applying pressurized air to each engaged cigarette via the mouthpiece means to force the tobacco from the cigarette and into a suitable collection device. Preferred apparatus is disclosed for accomplishing this method.

30 Claims, 4 Drawing Sheets

METHOD AND APPARATUS FOR EJECTING TOBACCO FROM FILTER CIGARETTES

TECHNICAL FIELD

The present invention relates to a method and apparatus for reclaiming tobacco from cigarettes.

BACKGROUND OF THE INVENTION

In the manufacture of cigarettes by high speed cigarette making machines, each cigarette is examined by automatic inspection devices to ensure that it meets certain quality standards. Cigarettes not meeting these quality standards are ejected from the production line and the valuable tobacco contained therein is normally recovered for recycling. A number of devices have been described in the prior art for reclaiming tobacco from cigarettes including those which subject the cigarette to mechanical forces which disrupt the cigarette paper to release the tobacco and those which direct a jet of air into the intact cigarette to force the tobacco from the paper tube surrounding the tobacco. Both the mechanical and the pneumatic type devices have their advantages and disadvantages and the type of device selected for use will depend on various factors including the number of rejected cigarettes generated by the manufacturing operation, the nature of the defects associated with the rejected cigarettes and the manner in which the reclaimed tobacco is to be recycled.

Tobacco reclaiming apparatus of the penumatic type is disclosed in U.S. Pat. Nos. 3,757,799 and 4,117,852. The apparatus in both patents employs pressurized air to eject the tobacco from cigarettes as the cigarettes are continuously moved past the air treating station. The sealing arrangement between the conduit supplying the pressurized air and the end of the cigarette against which the air is directed is somewhat tenuous. Thus, the apparatus of U.S. Pat. No. 3,757,799 includes a tobacco compressing step which facilitates ejection of the tobacco by the pressurized air subsequently applied. The apparatus of U.S. Pat. No. 4,117,852 utilizes a pneumatic positioning device which adjusts the position of each cigarette deposited on a fluted, rotary drum to ensure that the end of the cigarette will move into abutting relationship with the conduit supplying the pressurized air. Neither of these arrangements is entirely satisfactory, however, because they do not provide a consistent seal between the pressurized air conduit and the ends of the cigarettes.

SUMMARY OF THE INVENTION

The present invention involves a method and apparatus that pneumatically ejects tobacco from a filter cigarette.

It is a principal object of this invention to provide an effective method for consistently applying a predetermined level of pressurized air to the filter end of each cigarette to effect ejection of the tobacco from the cigarette.

It is a further object of this invention to provide efficient recovery of cut tobacco from filter cigarettes without significant physical degradation of the tobacco.

The apparatus of this invention comprises transport means for moving a succession of filter cigarettes in spaced relationship along a predetermined path, means for supplying a succession of filter cigarettes to said transport means, means for advancing the transport means in a discontinuous, indexing manner with a brief pause between indexed movements, reciprocating mouthpiece means for temporarily engaging the filter end of each filter cigarette at a point in the predetermined path along which the filter cigarettes move, means for supplying pressurized air to the reciprocating mouthpiece means for application of pressurized air to each filter cigarette while the reciprocating mouthpiece means engages the filter end of each filter cigarette, restraining means adjacent to the point at which the reciprocating mouthpiece means engages the filter end of each filter cigarette to restrict longitudinal movement of the engaged cigarette and means for coordinating the discontinuous, indexing movement of the transport means with the movement of the reciprocating mouthpiece means and the means for supplying pressurized air to the mouthpiece means so that pressurized air is applied to the filter end of each filter cigarette while the mouthpiece means engages the filter end of the cigarette during the brief pause between indexed movements of the transport means, thereby causing tobacco to be ejected from the filter cigarettes.

The present invention also provides a method for ejecting tobacco from filter cigarettes which involves advancing in a discontinuous, indexing manner a succession of filter cigarettes having a spaced relationship along a predetermined path with a brief pause between indexed movements, temporarily engaging the filter end of each filter cigarette at a point in the predetermined path with a reciprocating mouthpiece that is provided with orifice means for bringing the filter end of the engaged filter cigarette into communication with a supply of pressurized air, temporarily restraining each filter cigarette while its filter end is engaged by the reciprocating mouthpiece means to restrict longitudinal movement of the engaged filter cigarette and applying sufficient pressurized air to the filter end of each filter cigarette while it is engaged by the reciprocating mouthpiece means to eject cut tobacco from the end of the cigarette opposite the filter end.

DRAWINGS

Figure 6:
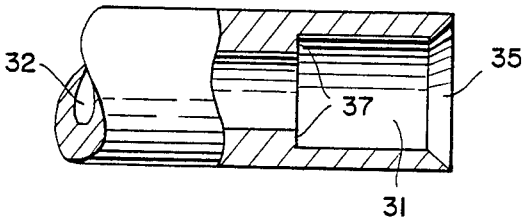
Figure 7:
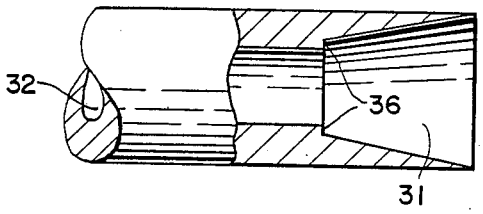

FIGS. 6 and 7 present partial sectional views of preferred mouthpieces which may be used with this invention.

DETAILED DESCRIPTION OF THE INVENTION

Figure 1:
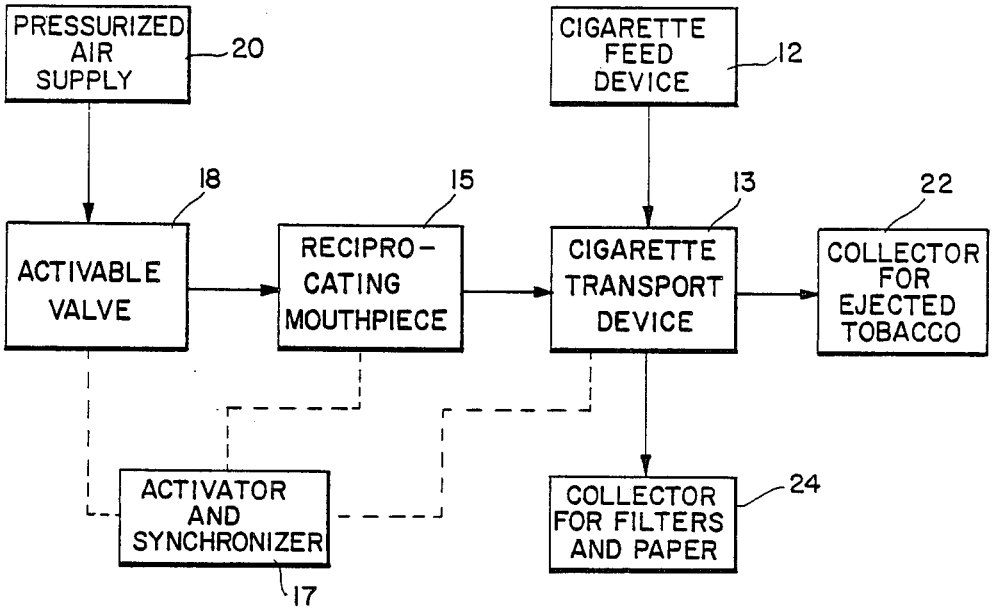
FIG. 1 is a schematic diagram of tobacco reclaiming apparatus in accordance with the present invention.

The apparatus of the present invention is generally depicted by the schematic diagram shown in FIG. 1. A succession of filter cigarettes is deposited by feed means 12 onto transport means 13 so that the filter end of each cigarette will face and be aligned with reciprocating mouthpiece 15 at a point in the predetermined path along which the filter cigarettes move. Activating and synchronizing means 17 moves transport means 13 in a discontinuous, indexing manner and causes reciprocating mouthpiece means to move into a position of engagement with the filter end of a cigarette carried by transport means 13 during an indexing pause of the transport device. Activating and synchronizing means 17 also activates valve 18 during the indexing pause and while a filter cigarette on transport means 13 is engaged by the reciprocating mouthpiece 15. Activation of valve 18 from its normally closed position allows air pressure from pressurized air supply 20 to be applied to the filter end of the cigarette via reciprocating mouthpiece 15. This applied air pressure causes tobacco to be ejected from the paper tube of the cigarette and the ejected tobacco is recovered by collection means 22. The filter and attached empty paper tube is subsequently moved by transport means 13 to a second point in the predetermined path of the filter cigarettes where the filter and empty paper tube are discharged from transport means into collector 24.

The particular means employed for performing the various functions of the apparatus may take a variety of forms so long as they are capable of functioning together in a synchronized and coordinated manner. It is important that filter cigarettes carried by transport means 13 be positioned properly with respect to reciprocating mouthpiece means 15 so that during engagement each filter will extend into the mouthpiece a sufficient distance to provide a substantially airtight seal that will result in virtually all of the pressurized air stream being directed through the interior portion of the filter. The levels of pressurized gas or air that are required to eject the tobacco from the cigarette will depend on a number of factors including the filter design, the presence of perforations in filter tipping paper commonly used in ventilated cigarettes and the compactness of the tobacco in the tobacco rod of the cigarette. Generally, pressures of at least 15 p.s.i.g. are required to eject the tobacco from the cigarettes and, preferably, pressures of at least 30 p.s.i.g. are applied to ensure that all of the tobacco is ejected from each cigarette. It is also desirable to limit the pressures used for ejecting tobacco in order to avoid the production of fines caused by ejected tobacco particles striking wall surfaces associated with the tobacco collection means 22. For this reason gas or air pressures employed with this invention for ejecting tobacco from cigarettes should be no greater than 60 p.s.i.g. and, preferably, no greater than 40 p.s.i.g.

Figure 3:
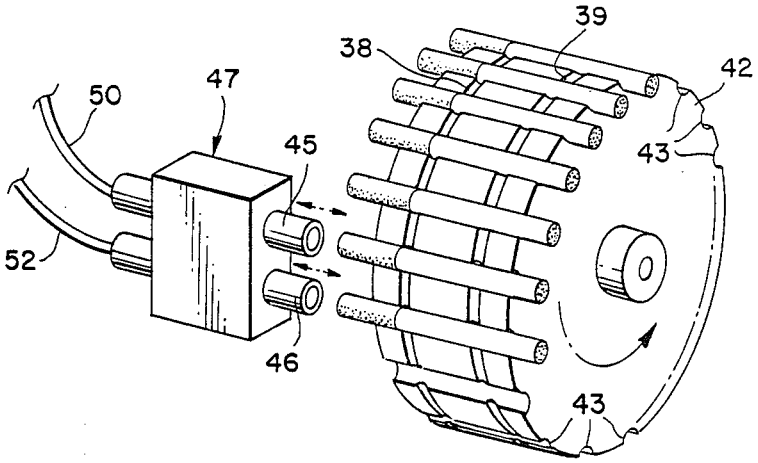
FIG. 3 is a perspective view showing portions of the cigarette transport drum and mouthpiece assembly of the FIG. 2 arrangement.
Figure 2:
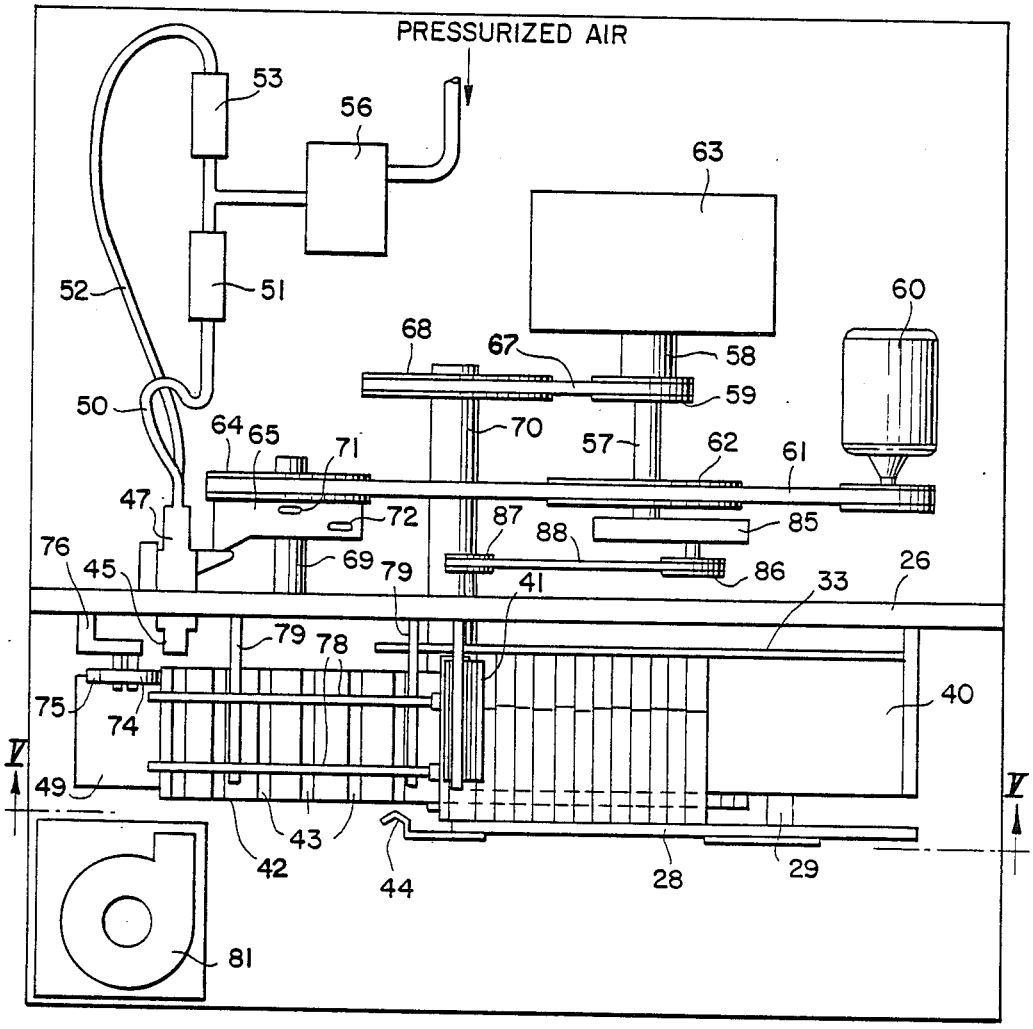
FIG. 2 is a plan view of a preferred embodiment for reclaiming tobacco from filter cigarettes.
Figure 5:
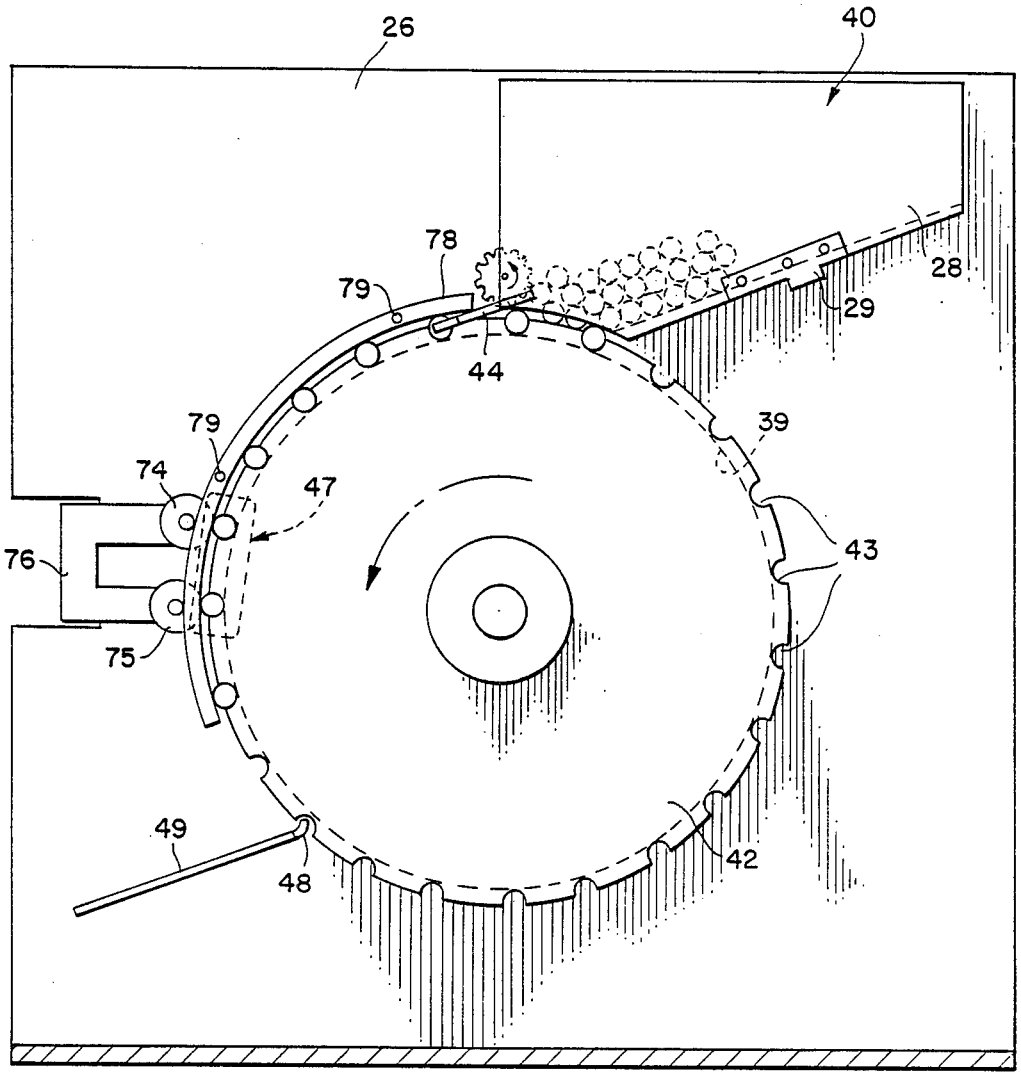
FIG. 5 is a view of the FIG. 2 arrangement taken along the line V—V.

In FIG. 2 is shown a plan view of a preferred arrangement for effecting the ejection of tobacco from filter cigarettes. Mounted on a vertically disposed support frame 26 is hopper 40 which is preferably provided with a rotatable feed roll 41 that facilitates the feeding of a succession of filter cigarettes from hopper 40 onto rotatable drum 42. The front wall 28 of hopper 40 is adjustably supported by bar 29 which is slidably mounted on a stationary bracket (not shown) to permit wall 28 to be moved toward and away from support frame 26 for the purpose of accommodating different length cigarettes. The peripheral surface of rotatable drum 42 is provided with uniformly spaced flutes or recesses 43 designed to receive and to retain the filter cigarettes as drum 42 moves the cigarettes to the air injection station. The peripheral surface of drum 42 is also provided with grooves 38 and 39 (see FIG. 3) which extend circumferentially around drum 42 and have depths similar to recesses 43. Grooves 38 and 39 are designed to accommodate projections 48 (see FIG. 5) attached to discharge chute 49 which extend into grooves 38 and 39 for the purpose of removing empty paper tubes and attached filters from recesses 43 on drum 42. Mouthpieces 45 and 46 mounted on reciprocating mouthpiece support assembly 47 (see FIG. 3) are positioned so that they each engage the filter end of a filter cigarette on drum 42 when the reciprocating mechanism (Deltron M-1 Ball Slide Assembly available from Automation Gauges Corp. of Rochester, N.Y.) moves mouthpiece support assembly 47 to its extreme position that is nearest to drum 42. Motor and gear means are employed to move drum 42 in a discontinuous, indexing manner a sufficient amount so that each of mouthpieces 45 and 46 engage alternate cigarettes positioned on drum 42. Flexible conduits 50 and 52 connect mouthpieces 45 and 46, respectively, with solenoid valves 51 and 53. A source of pressurized air supplies air at elevated pressures to each of solenoid valves 51 and 53 via pressure regulator 56.

Motor 60 is employed to drive Geneva mechanism 63 (model No. 4PM-12 available from Geneva Mechanisms Corporation of Tampa, Fla. by toothed belt 61 and drive wheel 62. Drive wheel 62 is mounted on shaft 57 which extends concentrically through hollow shaft 58 into mechanism 63. Shaft 57 also extends into stationary gearbox 85 to impart a continuous rotation to feed roll 141 via drive wheels 86 and 87 and associated belt 88. Toothed belt 61 also passes around wheel 64 and associated cam device 65 which rotate freely on support shaft 69. The rotation of cam device 65 causes a repeating sequence of steps that includes the movement of reciprocating mouthpiece support assembly 47 to the "engage" position followed by activation of two electrical switches (not shown) which operate solenoid valves 51 and 53 sequentially and allow pressurized air to be applied to the cigarettes engaged by each of mouthpieces 45 and 46. Raised contact points 71 and 72 on the peripheral surface of cam device 65 are designed to contact and to operate these electrical switches which are positioned immediately above the peripheral surface of cam device 65. Geneva mechanism 63 is also connected via shaft 58, drive wheel 59 and toothed belt 67 to drive wheel 68 which rotates drum 42 by means of connecting shaft 70. The continuous motion introduced into Geneva mechanism 63 by shaft 57 is translated into a discontinuous, indexed movement imparted to shaft 58 and drive wheel 59 affixed thereto. The various moving parts of the apparatus are interconnected in such a way that during the momentary pause of drum 42, the continued rotation of cam device 65 causes reciprocating mouthpiece support assembly 47 to move into the "engage" position and causes solenoid valves 51 and 53 to supply pressurized air to mouthpieces 45 and 46 in sequential fashion while they are in sealing engagement with the filter end of cigarettes positioned in recesses 43 on drum 42. Means are provided for restraining longitudinal movement of each filter cigarette while air pressure is applied to the filter and thereof. Rotatable wheels 74 and 75 (see FIG. 5) are adjustably mounted on bracket 76 attached to support frame 26 and are positioned directly adjacent to the recesses 43 which are in alignment with mouthpieces 45 and 46 during each indexing pause of drum 42. Rotatable wheels 74 and 75 are preferably positioned so that they contact each filter near the interface between the filter plug and the tobacco and apply sufficient force to maintain the filters and paper tubes in a relatively fixed position in recesses 43 as the applied air pressure causes ejection of the tobacco from the paper tubes of the filter cigarettes. The filters and empty paper tubes are removed from drum 42 by projections 48 attached to discharge chute 49 if they have not previously dropped onto discharge chute 49 (see FIG. 5) due to gravitational forces. The filter cigarettes deposited in recesses 43 as well as the filters and attached paper tubes remaining after ejection of the tobacco therefrom are held in recesses 43 by retaining rails 78 as drum 42 moves the filter cigarettes from hopper 40 to a point just above discharge chute 49. Rails 78 are arcuately shaped to approximate the arcuate shape of drum 42 and are adjustably mounted on support members 79 so that the rails overlie grooves 38 and 39. Rails 78 should preferably avoid the application of compressive force on the filter cigarettes as they are moved by drum 42.

Preferred embodiments of the mouthpiece means used in connection with this invention are shown in FIGS. 6 and 7. Each mouthpiece is provided with a cavity 31 that is designed to receive the filter end of a cigarette. Internal passageway 32 is in communication with cavity 31 and is also connected to a source of pressurized air or other suitable pressurized gaseous medium. The mouthpiece design of FIG. 6 incorporates a short section of tapered wall 35 at the entrance end of cavity 31 to facilitate entry of the filter end of the cigarette into cavity 31 as the mouthpiece moves toward the filter cigarette. A portion of cavity 31 comprises a substantially cylindrical passageway of reduced diameter with associated annular ledge 37. During temporary engagement of the cigarette by the mouthpiece, annular ledge 37 is brought into abutting contact with the filter end of the cigarette to provide a suitable seal between the end of the filter and ledge 37. The area of the abutting surface presented to the filter end of the cigarette by annular ledge 37 must be sufficient to prevent significant escape of the pressurized air or gaseous medium via pathways other than the interior portion of the filter. In the FIG. 7 mouthpiece design, cavity 31 is defined by inside walls that are tapered inwardly as viewed from the mouthpiece end into which the filter cigarette passes. The tapered walls extend from the entrance end of cavity 31 to a narrow annular ledge 36 which does not normally contact filter cigarettes entering cavity 31. The seal in this design results from contact between the tapered inside walls and the outer surface of the tipping paper on the filter cigarette. It is important that the cross-sectional area of internal passageway 32 be at least 55 percent of the cross-sectional area of the filter end of the cigarette to ensure that the pressurized air is applied to a substantial cross-sectional area of the end of the filter cigarette. If the stream of pressurized air is constricted too much by internal passageway 32, the tobacco will not be satisfactorily ejected from the filter cigarette.

Figure 4:
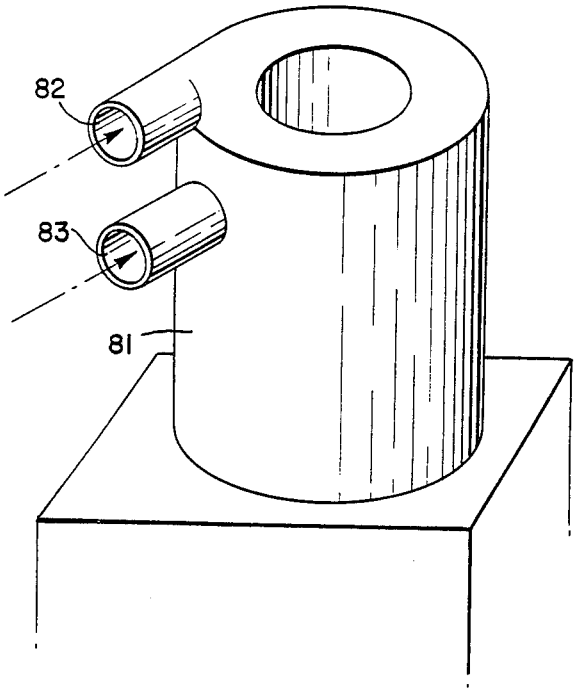
FIG. 4 is a perspective view of the tobacco separator shown in the FIG. 2 arrangement.

The tobacco ejected by the pressurized air applied to the filter cigarettes by mouthpieces 45 and 46 is recovered by tangential separator 81 (FIGS. 2 and 4) which is provided with inlets 82 and 83. Separator 81 is positioned so that inlets 82 and 83 are aligned with two adjacent recesses 43 on drum 42 during each brief pause between indexed movements of drum 42. A suitable container (not shown) is positioned below tangential separator 81 to collect the tobacco which falls by gravity to the bottom of separator 81.

Conventional manufacturing methods for filter cigarettes result in cigarette lengths which vary slightly. These variations may be of the order of 1 to 2 millimeters and they may affect the quality of the seal between the filter end of the cigarette and the engaging mouthpiece means such as those shown in FIGS. 6 and 7. This is due to the fact that adjustable front wall 28 of hopper 40 can only bring the ends of the cigarettes opposite the filter into precise alignment. Thus, any differences in cigarette length will result in variations of the position of each filter that is presented to the engaging mouthpiece. It is, therefore, preferred that the position of each cigarette be adjusted after it has been deposited onto rotatable drum 42. One preferred method for adjusting the position of each cigarette is shown in FIG. 2 wherein tab 44 attached to front wall 28 of hopper 40 is adapted to contact the end of each cigarette opposite the filter as rotatable drum 42 moves the cigarettes past tab 44. Tab 44 is fabricated from resilient or flexible material such as metal or plastic or is yieldably secured to front wall 28 so that it moves away from rotatable drum 42 as it contacts the end of each cigarette and applies sufficient force along the longitudinal axis of the contacted cigarette in the direction of the filter to move the filter end of the cigarette into contact with the stationary extension of hopper wall 33. Thus, each cigarette on rotatable drum 42 will have its filter end uniformly positioned relative to reciprocating mouthpiece support assembly 47 by virtue of the cooperative action of resilient tab 44 and the stationary extension of hopper wall 33. Alternative means instead of tab 44 may be used to impart longitudinal movement of the cigarettes on rotary drum 42. For example, an air jet directed against the end of the cigarette could be employed to move the filter cigarette into contact with the extension of hopper wall 33.

The apparatus depicted in FIGS. 2 through 5 represents one preferred embodiment of the present invention. It is apparent that similar apparatus employing a single reciprocating mouthpiece would be equally effective as would apparatus employing three or more mouthpieces. It would also be possible to have plural mouthpieces and tobacco separator inlets aligned with recesses on the rotary drum that are not adjacent to each other (e.g., filter cigarettes separated by two intermediate recesses 43 could be selected for simultaneous engagement by the plural mouthpiece means). A number of other modifications would also be evident to those skilled in the art. All such modifications which do not depart from the spirit and scope of the appended claims are considered to be a part of the present invention.

What is claimed is:

1. Apparatus for ejecting cut tobacco from filter cigarettes by applying pressurized air to the filter end of each cigarette comprising (a) transport means for moving a succession of filter cigarettes in spaced relationship along a predetermined path, (b) means for supplying a succession of filter cigarettes to said transport means, (c) means for advancing the transport means in an indexing manner with a brief pause between indexed movements, (d) reciprocating mouthpiece means for temporarily engaging the filter end of each filter cigarette at a point in the predetermined path along which the filter cigarettes move, said mouthpiece means being provided with a passageway through which pressurized air is applied to the filter end of each engaged filter cigarette, (e) restraining means adjacent to the point at which the reciprocating mouthpiece means engages the filter end of each filter cigarette, said restraining means being designed to contact and to restrict longitudinal movement of each engaged filter cigarette, (f) means for supplying pressurized air to said mouthpiece means while said reciprocating mouthpiece means engages the filter end of each filter cigarette and (g) means for coordinating the indexing advancement of the transport means with the movement of the reciprocating mouthpiece means and said means for supplying pressurized air to said mouthpiece means so that the reciprocating mouthpiece means engages the filter end of each filter cigarette and applies pressurized air to each engaged filter end during said brief pause between indexed movements of the transport means to eject the cut tobacco from said filter cigarettes.

2. The apparatus of claim 1 wherein the reciprocating mouthpiece means includes a plurality of mouthpieces designed to engage simultaneously a plurality of filter cigarettes at spaced points in said predetermined path.

3. The apparatus of claim 2 wherein said means for supplying pressurized air to said mouthpiece means includes means for applying pressurized air sequentially to the engaged filter cigarettes.

4. The apparatus of claim 1 which additionally includes means for adjusting the position of each filter cigarette while it is being advanced by said transport means and before the filter cigarette reaches said point in the predetermined path where the reciprocating mouthpiece means temporarily engages the filter end of the cigarette.

5. The apparatus of claim 4 wherein the means for adjusting the position of each filter cigarette comprises a stationary wall and flexible tab adapted to contact the end of the cigarette opposite the filter and to apply sufficient force along the longitudinal axis of the contacted cigarette in the direction of the filter to move the filter end of the cigarette into contact with the stationary wall.

6. The apparatus of claim 1, 2, 3, 4 or 5 wherein the portion of the reciprocating mouthpiece means which engages the filter end of the cigarette has inside walls that are tapered inwardly as viewed from the entrance end of said portion.

7. The apparatus of claim 6 which additionally includes means for recovering the cut tobacco ejected from the filter cigarette.

8. The apparatus of claim 7 wherein the means for recovering the cut tobacco comprises a tangential separator.

9. The apparatus of claim 1, 2, 3, 4 or 5 which additionally includes means for recovering the cut tobacco ejected from the filter cigarettes.

10. The apparatus of claim 9 wherein the means for recovering the cut tobacco comprises a tangential separator.

11. Apparatus for ejecting cut tobacco from filter cigarettes by applying pressurized air to the filter end of each cigarette comprising (a) a rotatable drum having uniformly spaced flutes disposed in the peripheral surface of the drum which are designed to accommodate individual cigarettes, said drum having an axis of rotation that is substantially horizontal and said flutes being essentially parallel to said axis of rotation, (b) a hopper provided with a feed roller adapted to deposit a succession of filter cigarettes in said flutes so that a portion of the filter end of each filter cigarette extends beyond the edge of the drum, (c) means for rotating said drum in an indexing manner with a brief pause between indexed movements, (d) reciprocating mouthpiece means designed to move a mouthpiece into temporary engagement with the filter end of each filter cigarette deposited in said flutes during said brief pause between indexed movements, said mouthpiece being provided with a passageway through which pressurized air is applied to the filter end of each engaged filter cigarette, (e) a rotatable wheel adjacent to the peripheral surface of the drum and to said mouthpiece, said wheel being designed to apply sufficient force to each engaged filter cigarette, to restrict longitudinal movement of the filter cigarette, (f) means for supplying regulated levels of pressurized air to said passageway in the reciprocating mouthpiece means while said mouthpiece engages the filter end of a filter cigarette, (g) means for coordinating the indexing movement of the drum with the movement of the reciprocating mouthpiece means and with the means for supplying pressurized air to the mouthpiece so that the pressurized air is supplied to the mouthpiece while the mouthpiece is in sealing engagement with the filter end of a filter cigarette during the brief pause between indexed movements of the drum, and (h) means for removing filters and paper tubes associated therewith from said flutes after the cut tobacco has been ejected from said paper tubes.

12. The apparatus of claim 11 wherein the reciprocating mouthpiece means includes a plurality of mouthpieces designed to engage simultaneously a plurality of filter cigarettes positioned in said flutes.

13. The apparatus of claim 12 wherein the means for supplying pressurized air to the passageway in said mouthpiece includes means for applying pressurized air sequentially to the engaged filter cigarettes.

14. The apparatus of claim 13 wherein the reciprocating mouthpiece means includes two mouthpieces and the means for rotating said drum is designed to rotate the drum during each indexed movement a sufficient amount so that each mouthpiece engages alternate filter cigarettes positioned in said flutes.

15. The apparatus of claim 11, 12, 13 or 14 which additionally includes means for adjusting the position of the filter cigarettes deposited in said flutes before the filter ends of said cigarettes are engaged by said mouthpiece.

16. The apparatus of claim 15 which additionally includes means for recovering the cut tobacco ejected from the filter cigarettes.

17. The apparatus of claim 16 wherein the means for recovering the cut tobacco comprises a tangential separator.

18. The apparatus of claim 15 wherein the means for adjusting the position of the filter cigarettes deposited in said flutes comprises a stationary wall and a flexible tab adapted to contact the end of each cigarette opposite the filter and to apply sufficient force along the longitudinal axis of the contacted cigarette in the direction of the filter to move the filter end of the cigarette into contact with the stationary wall.

19. The apparatus of claim 11, 12, 13 or 14 wherein the portion of the mouthpiece which engages and circumferentially surrounds the filter end of the filter cigarette has inside walls that are tapered inwardly as viewed from the mouthpiece end into which the filter cigarette passes.

20. The apparatus of claim 19 which additionally includes means for recovering the cut tobacco ejected from the filter cigarettes.

21. The apparatus of claim 20 wherein the means for recovering the cut tobacco comprises a tangential separator.

22. The apparatus of claim 11, 12, 13 or 14 wherein the peripheral surface of said rotatable drum is provided with a groove which extends circumferentially around the drum and which is designed to cooperate with said means for removing filters and paper tubes from the flutes.

23. The apparatus of claim 22 which additionally includes an arcuately shaped retaining rail adjacent to the peripheral surface of said drum and extending from said hopper to a point between said reciprocating mouthpiece means and said means for removing filters and paper tubes associated therewith, said retaining rail being adapted to maintain the filter cigarettes in said flutes without the application of significant compressive forces to the individual filter cigarettes.

24. A method for ejecting cut tobacco from filter cigarettes by applying pressurized air to the filter end of each cigarette which comprises (a) advancing in a discontinuous, indexing manner a succession of filter cigarettes having a spaced relationship along a predetermined path with a brief pause between indexed movements, (b) temporarily engaging the filter end of each filter cigarette with reciprocating mouthpiece means at a point in said predetermined path, said mouthpiece means having orifice means for bringing the filter end of each filter cigarette into communication with a supply of pressurized air, (c) temporarily restraining each filter cigarette while its filter end is engaged by the reciprocating mouthpiece means to restrict longitudinal movement of the engaged filter cigarette and (d) applying sufficient pressurized air to the filter end of each filter cigarette while it is engaged by the reciprocating mouthpiece means to eject cut tobacco from the end of the cigarette opposite the filter end.

25. Method of claim 24 which includes the additional step of adjusting the position of each advancing filter cigarette to present uniform positioning of the filter ends of the cigarettes to said reciprocating mouthpiece means.

26. The method of claim 24 or 25 wherein the reciprocating mouthpiece means simultaneously engages a plurality of filter cigarettes at spaced points in said predetermined path.

27. The method of claim 26 wherein the pressurized air is sequentially applied to each of the engaged filter cigarettes.

28. The method of claim 27 wherein the pressurized air applied to the filter end of each filter cigarette is within the range of 15 to 60 pounds per square inch (gauge).

29. The method of claim 24 or 25 wherein the cut tobacco ejected from the filter cigarettes is directed into tangential separator means.

30. The method of claim 24 or 25 wherein the pressurized air applied to the filter end of each filter cigarette is within the range of 15 to 60 pounds per square inch (gauge).

* * * * *

UNITED STATES PATENT AND TRADEMARK OFFICE

CERTIFICATE OF CORRECTION

PATENT NO. : 4,763,673

DATED : August 16, 1988

INVENTOR(S) : Vernon B. Barnes et al.

It is certified that error appears in the above—identified patent and that said Letters Patent is hereby corrected as shown below:

Column 4, line 25, change "141" to --41--.

Column 4, line 56, change "and" to --end--.

Signed and Sealed this

Third Day of January, 1989

*Attest:*

DONALD J. QUIGG

*Attesting Officer*

*Commissioner of Patents and Trademarks*